US008820440B2

(12) United States Patent
Hall et al.

(10) Patent No.: US 8,820,440 B2
(45) Date of Patent: Sep. 2, 2014

(54) DRILL BIT STEERING ASSEMBLY

(76) Inventors: David R. Hall, Provo, UT (US); Scott Dahlgren, Alpine, UT (US); Jonathan Marshall, Provo, UT (US)

( * ) Notice: Subject to any disclaimer, the term of this patent is extended or adjusted under 35 U.S.C. 154(b) by 741 days.

(21) Appl. No.: 12/956,915

(22) Filed: Nov. 30, 2010

(65) Prior Publication Data

US 2012/0080234 A1 Apr. 5, 2012

Related U.S. Application Data

(63) Continuation-in-part of application No. 12/896,063, filed on Oct. 1, 2010.

(51) Int. Cl.
*E21B 7/04* (2006.01)
*E21B 7/08* (2006.01)

(52) U.S. Cl.
USPC ..... 175/385; 175/61; 175/62; 175/263; 175/266; 175/75

(58) Field of Classification Search
CPC ..... E21B 10/26; E21B 7/064
USPC ..... 175/57, 61, 62, 263, 276, 317, 258, 175/262, 352, 385, 327, 73
See application file for complete search history.

(56) References Cited

U.S. PATENT DOCUMENTS 616,118 A 12/1889 Kunhe
465,103 A 12/1891 Wegner
946,060 A 1/1910 Looker
1,116,154 A 11/1914 Stowers
1,183,630 A 5/1916 Bryson
1,189,560 A 7/1916 Gondos
1,360,908 A 11/1920 Everson
1,387,733 A 8/1921 Midgett
1,460,671 A 7/1923 Hebsackar
1,544,757 A 7/1925 Hufford
2,169,223 A 8/1931 Christian
1,821,474 A 9/1931 Mercer
1,879,177 A 9/1932 Gault
2,054,255 A 9/1936 Howard
2,064,255 A 12/1936 Garfield
2,218,130 A 10/1940 Court
2,320,136 A 5/1943 Kammerer
2,466,991 A 4/1949 Kammerer
2,540,464 A 2/1951 Stokes
2,544,036 A 3/1951 Kammerer
2,755,071 A 7/1956 Kammerer
2,776,819 A 1/1957 Brown
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,135,341 A 6/1964 Ritter (Continued)

*Primary Examiner* — James Sayre
(74) *Attorney, Agent, or Firm* — Philip W. Townsend, III

(57) ABSTRACT

In one aspect of the present invention, a steering assembly for downhole directional drilling comprises an outer bit comprising a bore and an outer cutting area and in inner bit comprising an inner cutting area and connected to a shaft that is disposed within the bore. At least one biasing mechanism is disposed around the shaft. At least one fluid channel is disposed within the outer bit and redirects fluid to the at least one biasing mechanism causing the at least one biasing mechanism to push the shaft and alter an axis of the inner bit with respect to an axis of the outer bit.

19 Claims, 10 Drawing Sheets

(56) References Cited

U.S. PATENT DOCUMENTS

| | | | | |
|---|---|---|---|---|
| 3,294,186 | A | 12/1966 | Buell | |
| 3,301,339 | A | 1/1967 | Pennebaker, Jr. | |
| 3,379,264 | A | 4/1968 | Cox | |
| 3,429,390 | A | 2/1969 | Bennett | |
| 3,493,165 | A | 2/1970 | Schonfield | |
| 3,583,504 | A | 6/1971 | Aalund | |
| 3,765,493 | A | 10/1973 | Rosar et al. | |
| 3,821,993 | A | 7/1974 | Kniff | |
| 3,955,635 | A | 5/1976 | Skidmore | |
| 3,960,223 | A | 6/1976 | Kleine | |
| 4,081,042 | A | 3/1978 | Johnson | |
| 4,096,917 | A | 6/1978 | Harris | |
| 4,106,577 | A | 8/1978 | Summer | |
| 4,176,723 | A | 12/1979 | Arceneaux | |
| 4,253,533 | A | 3/1981 | Baker | |
| 4,280,573 | A | 7/1981 | Sudnishnikov | |
| 4,304,312 | A | 12/1981 | Larsson | |
| 4,307,786 | A | 12/1981 | Evans | |
| 4,397,361 | A | 8/1983 | Langford | |
| 4,416,339 | A | 11/1983 | Baker | |
| 4,445,580 | A | 5/1984 | Sahley | |
| 4,448,269 | A | 5/1984 | Ishikawa | |
| 4,499,795 | A | 2/1985 | Radtke | |
| 4,531,592 | A | 7/1985 | Hayatdavoudi | |
| 4,535,853 | A | 8/1985 | Ippolito | |
| 4,538,691 | A | 9/1985 | Dennis | |
| 4,566,545 | A | 1/1986 | Story | |
| 4,574,895 | A | 3/1986 | Dolezal | |
| 4,640,374 | A | 2/1987 | Dennis | |
| 4,852,672 | A | 8/1989 | Behrens | |
| 4,889,017 | A | 12/1989 | Fuller | |
| 4,962,822 | A | 10/1990 | Pascale | |
| 4,981,184 | A | 1/1991 | Knowlton | |
| 5,009,273 | A | 4/1991 | Grabinski | |
| 5,027,914 | A | 7/1991 | Wilson | |
| 5,038,873 | A | 8/1991 | Jurgens | |
| 5,119,892 | A | 6/1992 | Clegg | |
| 5,141,063 | A | 8/1992 | Quesenbury | |
| 5,186,268 | A | 2/1993 | Clegg | |
| 5,222,566 | A | 6/1993 | Taylor | |
| 5,255,749 | A | 10/1993 | Bumpurs | |
| 5,265,682 | A | 11/1993 | Russell | |
| 5,361,859 | A | 11/1994 | Tibbitts | |
| 5,410,303 | A | 4/1995 | Comeau | |
| 5,417,292 | A | 5/1995 | Polakoff | |
| 5,423,389 | A | 6/1995 | Warren | |
| 5,507,357 | A | 4/1996 | Hult | |
| 5,560,440 | A | 10/1996 | Tibbitts | |
| 5,568,838 | A | 10/1996 | Struthers | |
| 5,655,614 | A | 8/1997 | Azar | |
| 5,678,644 | A | 10/1997 | Fielder | |
| 5,732,784 | A | 3/1998 | Nelson | |
| 5,794,728 | A | 8/1998 | Palmberg | |
| 5,896,938 | A | 4/1999 | Moeny | |
| 5,947,215 | A | 9/1999 | Lundell | |
| 5,950,743 | A | 9/1999 | Cox | |
| 5,957,223 | A | 9/1999 | Doster | |
| 5,957,225 | A | 9/1999 | Sinor | |
| 5,967,247 | A | 10/1999 | Pessier | |
| 5,979,571 | A | 11/1999 | Scott | |
| 5,992,547 | A | 11/1999 | Caraway | |
| 5,992,548 | A | 11/1999 | Silva | |
| 6,021,859 | A | 2/2000 | Tibbitts | |
| 6,039,131 | A | 3/2000 | Beaton | |
| 6,131,675 | A | 10/2000 | Anderson | |
| 6,150,822 | A | 11/2000 | Hong | |
| 6,186,251 | B1 | 2/2001 | Butcher | |
| 6,202,761 | B1 | 3/2001 | Forney | |
| 6,213,226 | B1 | 4/2001 | Eppink | |
| 6,223,824 | B1 | 5/2001 | Moyes | |
| 6,269,893 | B1 | 8/2001 | Beaton | |
| 6,296,069 | B1 | 10/2001 | Lamine | |
| 6,340,064 | B2 | 1/2002 | Fielder | |
| 6,364,034 | B1 | 4/2002 | Schoeffler | |
| 6,394,200 | B1 | 5/2002 | Watson | |
| 6,439,326 | B1 | 8/2002 | Huang | |
| 6,474,425 | B1 | 11/2002 | Truax | |
| 6,484,825 | B2 | 11/2002 | Watson | |
| 6,510,906 | B1 | 1/2003 | Richert | |
| 6,513,606 | B1 | 2/2003 | Krueger | |
| 6,533,050 | B2 | 3/2003 | Molloy | |
| 6,594,881 | B2 | 7/2003 | Tibbitts | |
| 6,601,454 | B1 | 8/2003 | Botnan | |
| 6,622,803 | B2 | 9/2003 | Harvey | |
| 6,668,949 | B1 | 12/2003 | Rives | |
| 6,729,420 | B2 | 5/2004 | Mensa-Wilmot | |
| 6,732,817 | B2 | 5/2004 | Dewey | |
| 6,822,579 | B2 | 11/2004 | Goswani | |
| 6,929,076 | B2 | 8/2005 | Fanuel | |
| 6,953,096 | B2 | 10/2005 | Glenhill | |
| 7,207,398 | B2 * | 4/2007 | Runia et al. | 175/61 |
| 2003/0213621 | A1 | 11/2003 | Britten | |
| 2004/0238221 | A1 | 12/2004 | Runia | |
| 2004/0256155 | A1 | 12/2004 | Kriesels | |
| 2006/0157281 | A1 * | 7/2006 | Downton | 175/61 |
| 2007/0227775 | A1 * | 10/2007 | Ma et al. | 175/26 |
| 2010/0006341 | A1 * | 1/2010 | Downton | 175/61 |
| 2010/0139980 | A1 * | 6/2010 | Neves et al. | 175/61 |
| 2011/0031022 | A1 * | 2/2011 | Johnson | 175/61 |

* cited by examiner

DRILL BIT STEERING ASSEMBLY

CROSS REFERENCE TO RELATED APPLICATIONS

This application is a continuation in part of U.S. patent application Ser. No. 12/896,063, which was filed on Oct. 1, 2010.

BACKGROUND OF THE INVENTION

The present invention relates to drill bit assemblies, specifically steering assemblies used for downhole directional drilling. The prior art discloses bit directional drilling bit assemblies.

U.S. Pat. No. 7,207,398 to Runia et al., which is herein incorporated by reference for all that it contains, discloses a rotary drill bit assembly suitable for directionally drilling a borehole into an underground formation, the drill bit assembly having a bit body extending along a central longitudinal bit-body axis, and having a bit-body face at its front end, wherein an annular portion of the bit-body face is provided with one or more chip-making elements; a pilot bit extending along a central longitudinal pilot-bit axis, the pilot bit being partly arranged within the bit body and projecting out of the central portion of the bit-body face, the pilot bit having a pilot-bit face provided with one or more chip-making elements at its front end; a joint means arranged to pivotably connect the pilot bit to the bit body so that the bit-body axis and the pilot-bit axis can form a variable diversion angle; and a steering means arranged to pivot the pilot bit in order to steer the direction of drilling.

U.S. Pat. No. 7,360,610 to Hall et al., which is herein incorporated by reference for all that it contains, discloses a drill bit assembly which has a body portion intermediate a shank portion and a working portion, the working portion having at least one cutting element. A shaft is supported by the body portion and extends beyond the working portion. The shaft also has a distal end that is rotationally isolated from the body portion. The assembly comprises an actuator which is adapted to move the shaft independent of the body portion. The actuator may be adapted to move the shaft parallel, normal, or diagonally with respect to an axis of the body portion.

BRIEF SUMMARY OF THE INVENTION

In one aspect of the present invention, a steering assembly for downhole directional drilling comprises an outer bit comprising a bore and an outer cutting area, and in inner bit comprising an inner cutting area and connected to a shaft that is disposed within the bore. At least one biasing mechanism is disposed around the shaft. At least one fluid channel is disposed within the outer bit and redirects fluid to the at least one biasing mechanism causing the at least one biasing mechanism to push the shaft and alter an axis of the inner bit with respect to an axis of the outer bit.

The at least one biasing mechanism may comprise an expandable element configured to expand, a piston configured to slide within a chamber, or a ball configured to roll within a cylinder. The biasing mechanism may be configured to push the shaft to alter the axis of the inner bit. The expandable element may comprise a composite, rubber, metal, ceramic, and combinations thereof. In some embodiments, at least three biasing mechanisms may be equally spaced around the shaft.

A ring may be disposed intermediate the shaft and the at least one biasing mechanism and may be configured to act as a buffer between the shaft and the at least one biasing mechanism. The ring may be axially fixed to the bore and configured to slide radially due to pressure from the at least one biasing mechanism.

The ring may comprise one continuous body and may enclose the at least one biasing mechanism to protect the at least one biasing mechanism from drilling fluid disposed within the bore. A plurality of vanes may be axially disposed within the ring intermediate a plurality of biasing mechanisms wherein the at least one biasing mechanism comprises a pressure region defined by the plurality of vanes. The ring may be directly connected to a piston configured to slide within a chamber and force the ring to push the shaft and alter the axis of the inner bit.

The inner bit may protrude from the outer bit and may be configured to rotate in a same direction as the outer bit. At least one fluid nozzle may be disposed on the inner cutting area or a gauge portion of the inner bit. The outer bit may be rigidly connected to a drill string and the inner bit may be rigidly connected to a torque transmitting device disposed within the bore.

A valve may be disposed within the at least one fluid channel and may be configured to control fluid to the at least one biasing mechanism. The fluid may be drilling fluid.

In another aspect of the present invention, a method of steering a downhole drill string comprises the steps of providing an outer bit comprising a bore and an outer cutting area, an inner bit comprising an inner cutting area and connected to a shaft that is disposed within the bore, at least one biasing mechanism disposed around the shaft, and at least one fluid channel disposed within the outer bit; deploying the drill string within a wellbore; redirecting a fluid through the at least one fluid channel to the at least one biasing mechanism; and pushing the shaft of the inner bit with the at least one biasing mechanism.

DETAILED DESCRIPTION OF THE INVENTION AND THE PREFERRED EMBODIMENT

Figure 1:
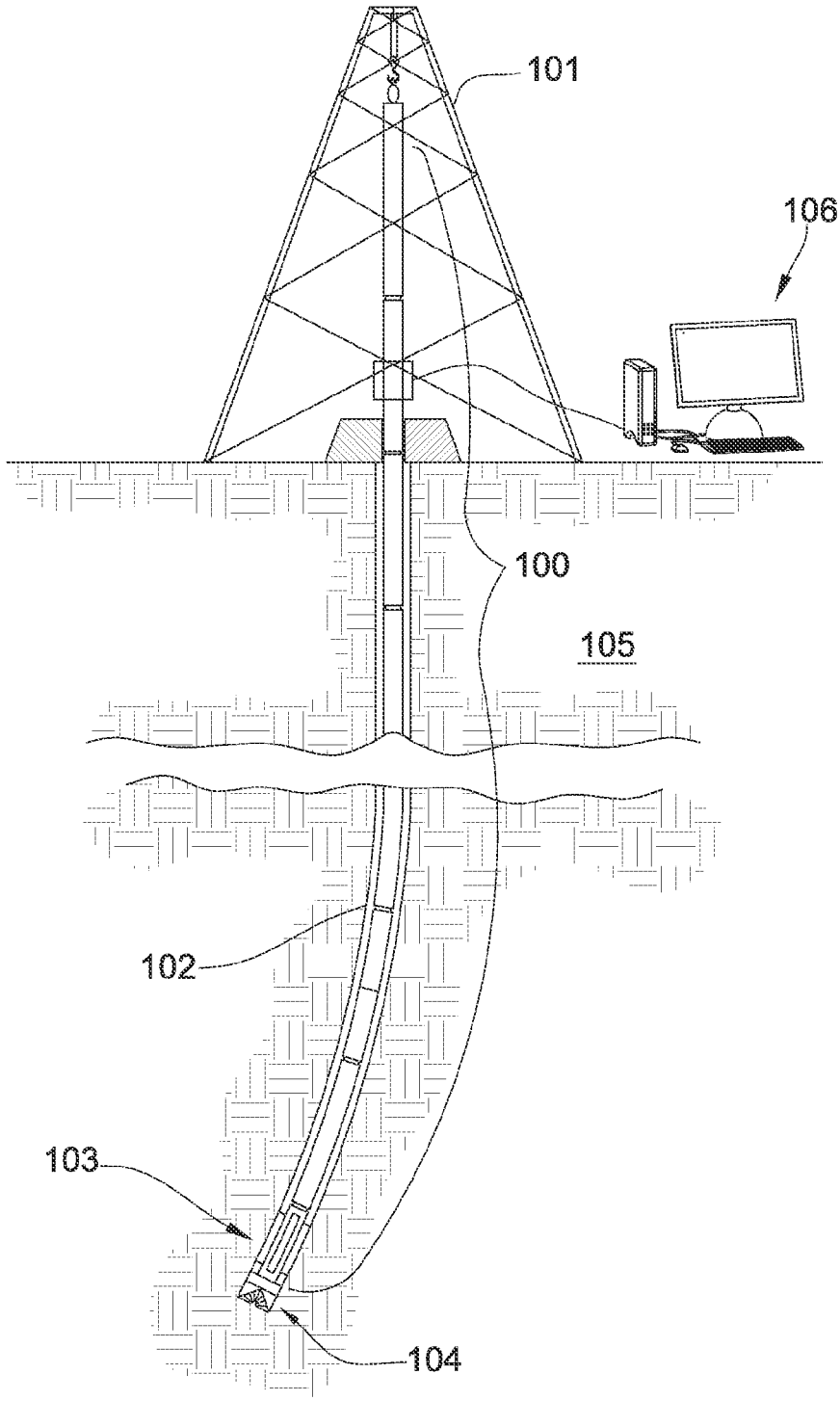
FIG. 1 is a perspective view of an embodiment of a drilling operation.

Referring now to the figures, FIG. 1 discloses a perspective view of an embodiment of a drilling operation comprising a downhole tool string 100 suspended by a derrick 101 in a wellbore 102. A steering assembly 103 may be located at the bottom of the wellbore 102 and may comprise a drill bit 104.

As the drill bit 104 rotates downhole, the downhole tool string 100 advances farther in to the earth. The downhole tool string 100 may penetrate soft or hard subterranean formations 105. The steering assembly 103 may be adapted to steer the drill string 100 in a desired trajectory. The downhole tool string 100 may comprise electronic equipment capable of sending signals through a data communication system to a computer or data logging system 106 located at the surface.

Figure 2:
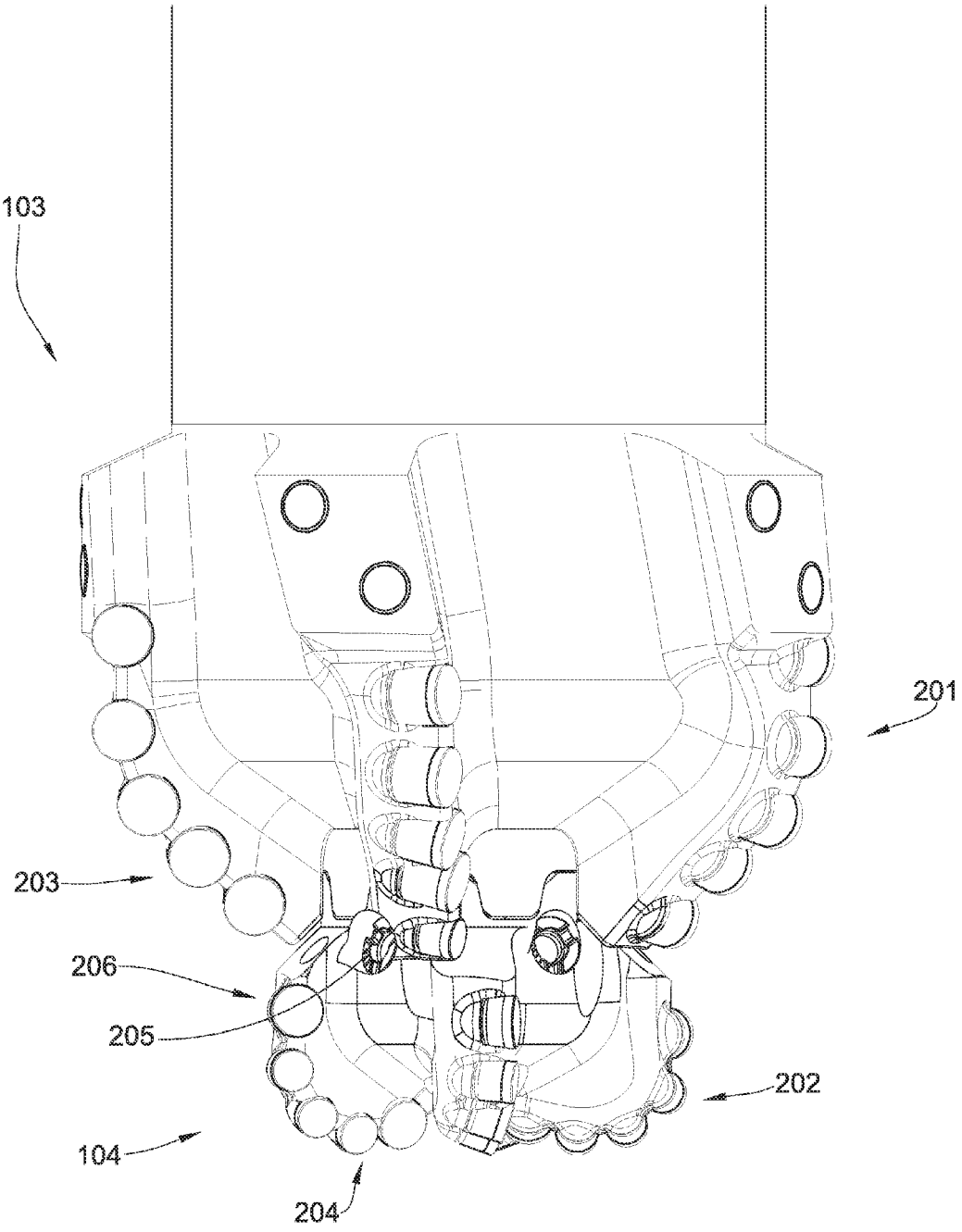
FIG. 2 is a perspective view of an embodiment of a drill bit assembly.

FIG. 2 discloses a perspective view of an embodiment of the drill bit assembly 103 comprising the drill bit 104. The drill bit 104 may comprise an outer bit 201 and an inner bit 202. The drill bit assembly 103 may be a steerable drill bit assembly used for downhole directional drilling. The inner bit 202 may contact the formation at an angle different than an angle the outer bit 201 contacts the formation. As drilling continues, the trajectory of the drill string assembly 103 may align with the angle the inner bit 202 contacts the formation.

The outer bit 201 may comprise an outer cutting area 203 and the inner bit 202 may comprise an inner cutting area 204. The outer cutting area 203 and the inner cutting area 204 may each comprise a plurality of blades converging towards the center of the outer bit 201 and inner bit 202 respectively, and diverging at an outer diameter of the outer bit 201 and inner bit 202 respectively. In some embodiments, the outer diameter of each of the outer bit 201 and inner bit 202 is a gauge portion. The blades may be equipped with a plurality of cutting elements that degrade the formation.

The inner bit 202 may protrude from the outer bit 201. The drill bit 104 may more rapidly steer the drill sting when the inner bit 202 is protruding from the outer bit 201 because the drill string may more easily react to the angle of contact between the formation and inner bit 202. Also, during drilling operations the inner bit 202 may begin to degrade the formation before the outer bit 201 comes into contact with the formation. The inner bit 202 may weaken the formation such that when the outer bit 201 contacts the formation, it may degrade the weakened formation at a higher rate than it would if the formation had not been weakened. In some embodiments, the inner bit 202 may be configured to move axially with respect to the outer bit 201 such that the inner bit 202 may protrude and retract within the outer bit 201.

This embodiment further discloses at least one fluid nozzle 205 disposed on the inner cutting area 204 or a gauge portion 206 of the inner bit 202. During drilling operations, pieces of the formation may be deposited onto the cutting elements of the outer bit 201 or the inner bit 202 causing the cutting elements to engage in the formation less effectively. The fluid expelled from the fluid nozzle 205 may strike the cutting elements removing any formation deposited on the cutting elements. The fluid nozzle 205 incorporated into the gauge 206 of the inner bit 202 may be configured to convey fluid across the outer cutting area 203 so to directly or tangentially strike the cutting elements disposed on the outer cutting area 203. Fluid from the nozzle 205 may also remove degraded formation from the bottom of the wellbore. The degraded formation may be removed through an annulus surrounding the drill string. Removing the degraded formation may allow the drill bit 104 to engage in the ungraded formation more effectively.

Figure 3:
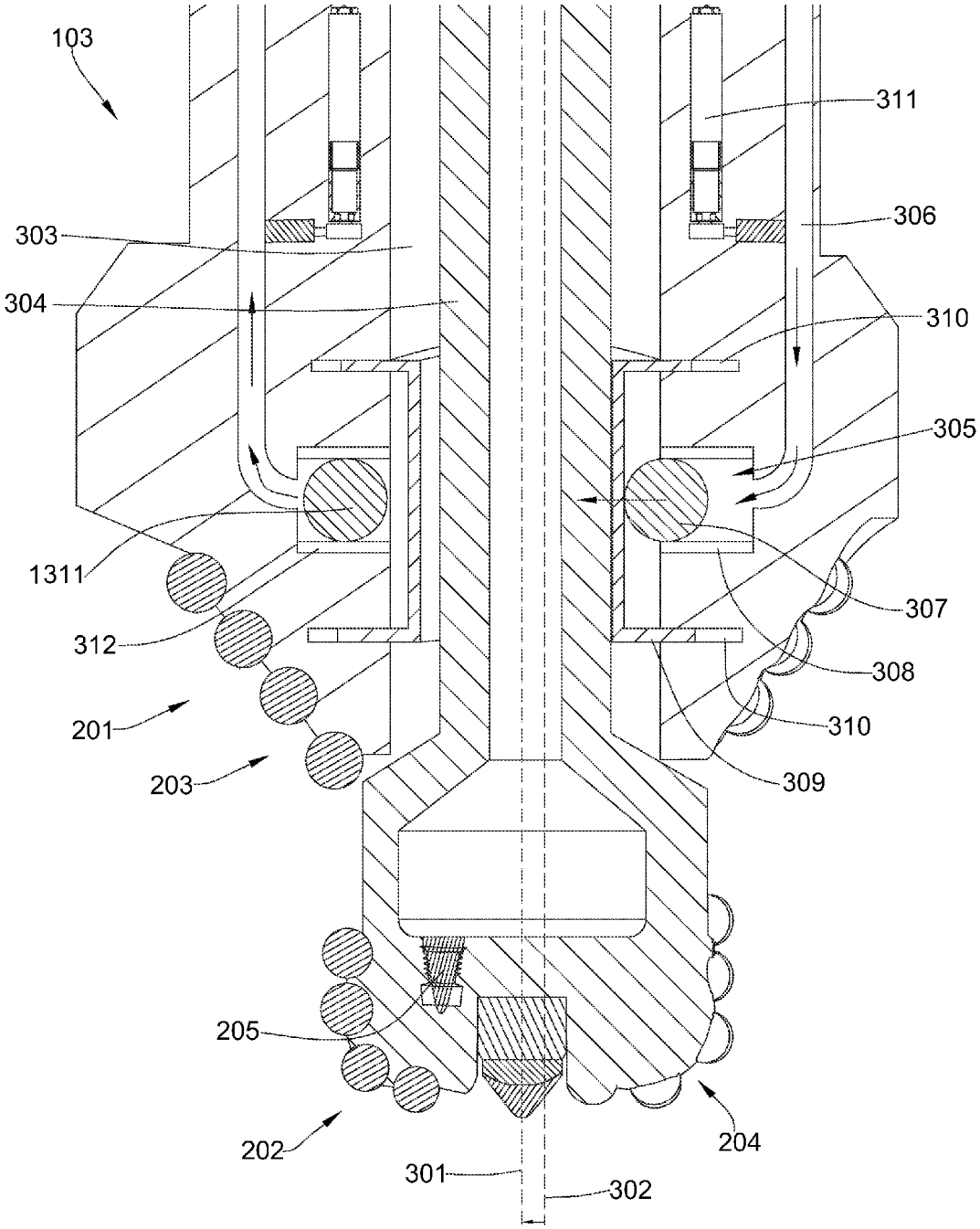
FIG. 3 is a cross-sectional view of another embodiment of a drill bit assembly.

FIG. 3 discloses a cross-sectional view of an embodiment of the drill bit assembly 103 comprising the outer bit 201 and inner bit 202. The inner bit 202 of the drill bit assembly 103 may steer the drill string in a desired trajectory when an axis 301 of the inner bit 202 is altered with respect to an axis 302 of the outer bit 201. By altering the axis 301, the inner bit 202 may contact the formation at a different angle than the angle the outer bit 201 contacts the formation.

This embodiment discloses the drill bit assembly 103 wherein the outer bit 201 comprises a bore 303. The bore 303 may be defined by an inner diameter of the outer bit 201. The inner bit 202 may be connected to a shaft 304 that is disposed within the bore 303. At least one biasing mechanism 305 may be disposed around the shaft 304. At least one fluid channel 306 may be disposed within the outer bit 201. Fluid may be directed through the fluid channel 306 to the biasing mechanism 305 causing the biasing mechanism 305 to push the shaft and alter the axis 301 with respect to the axis 302.

In this embodiment, a ring 309 may be disposed intermediate the shaft 304 and the biasing mechanism 305. The ring 309 may be configured to act as a buffer between the shaft 304 and the biasing mechanism 305 such that the biasing mechanism 305 biases the ring 309 forcing the ring 309 to push the shaft 304 and alter the axis 301. A ring 309 may be directly connected to the bore 303 by being disposed within at least one slot 310. The ring 309 may move radially within the slot 310. By moving radially, the ring 309 may be biased from the biasing mechanism 305 and push against the shaft 304. The slot 310 may axially fix the ring 309 to the bore 303. In this embodiment, the ring 309 may be disposed within two slots 310 to enclose the biasing mechanism 305. The ring 309 may protect the biasing mechanism 305 from drilling fluid and debris disposed within the bore which may increase the service life of the biasing mechanism 305.

The fluid channel 306 may comprise a valve 311 configured to control the amount of fluid to the biasing mechanism 305. The fluid may be drilling fluid or hydraulic fluid separated from the drilling fluid. Drilling fluid may be already present in normal drilling operations and can be released to an annulus surrounding the drill string. When the valve 311 is closed, the drilling fluid may be prevented from entering the fluid channel 306 and may flow through the inner bit 202 and out of the fluid nozzles 205. The valve may be in communication with a downhole telemetry or electrical circuitry system.

In some embodiments, a plurality of biasing mechanisms 305 may be equally spaced around the shaft 304. When a straight trajectory is desired, the valves 311 distribute the drilling fluid such that a substantially equal amount of fluid flows through to each biasing mechanism 305. In some embodiments, the fluid channels 306 may be open to supply a constant flow of drilling fluid.

The present embodiment also discloses the biasing mechanism 305 comprising a Ball 307 disposed within a cylinder 308. As fluid is directed through the fluid channel 306, the ball 307 may roll within the cylinder 308 and engage the ring 309 thus altering the inner bit's axis 301. At the same time other balls 1311 may roll within other cylinders 312 to allow the shaft 304 to be pushed toward the other balls 1311. By rolling back and forth, the balls 307 and 1311 cause the axis 301 to shift and thus steer the drill bit assembly 103. It is believed that the biasing mechanism 305 comprising the ball 307 may be advantageous because the ball 307 may easily roll within the cylinder 308 when fluid pressure is applied to it.

This embodiment may also disclose a method of steering the downhole drill string. The method may comprise the steps of providing an outer bit 201 comprising a bore 303 and an outer cutting area 203, an inner bit 202 comprising an inner cutting area 204 and connected to a shaft 304 that is disposed within the bore 303, at least one biasing mechanism 305 disposed around the shaft 304, and at least one fluid channel 306 disposed within the outer bit 201; deploying the drill string within a wellbore; redirecting a fluid through the fluid channel 306 to the biasing mechanism 305; and pushing the shaft 304 of the inner bit 202 with the biasing mechanism 305.

Figure 4:
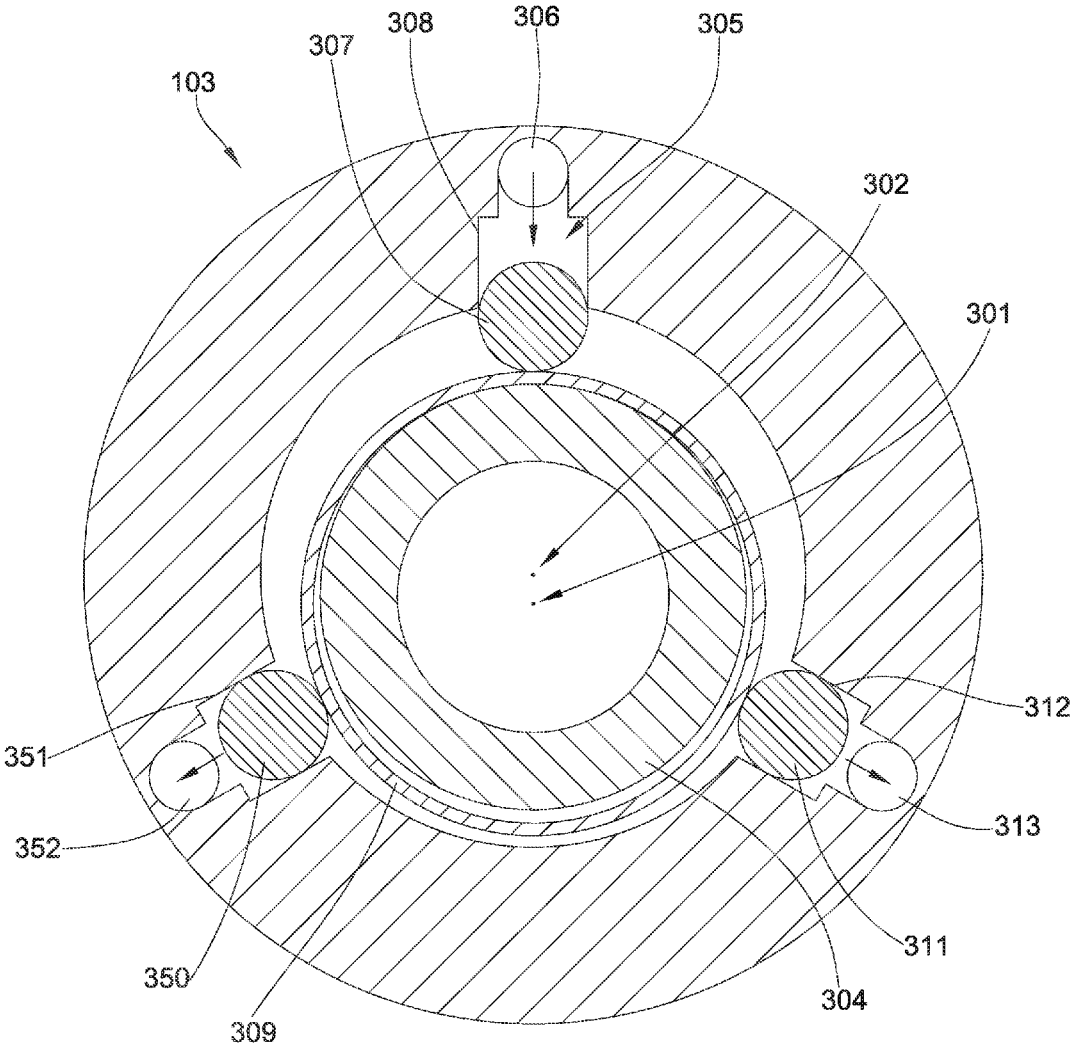
FIG. 4 is a cross-sectional view of another embodiment of a drill bit assembly.

FIG. 4 discloses a cross-sectional view of an embodiment of the drill bit assembly 103 comprising the ring 309 and the biasing mechanism 305. The biasing mechanism 305 may comprise the ball 307 within the cylinder 308. The ball 307 and the other balls 1311, 350 may form three biasing mechanisms equally spaced around the shaft 304. It is believed that three biasing mechanisms may allow the drill string to move in any desired trajectory. The ring 309 may be disposed intermediate each of the three biasing mechanisms and the shaft 304. The ring 309 may comprise one continuous body surrounding the shaft 304 allowing the ring 309 to move as a unitary unit around the shaft 304. Thus, as one of the biasing mechanisms biases the ring 309 on one side of the ring 309, the other side of the ring 309 will also move in that direction.

This embodiment discloses the drill bit assembly 103 as it is steering the drill string. Fluid may flow through the fluid channel 306 and apply pressure to the ball 307. As pressure is applied to the ball 307, the ball 307 biases the ring 309 forcing the ring 309 to push the shaft 304 and from axis 301 to axis 302. As the ring 309 is pushed, the other balls 31, 3501 may roll within the other cylinders 312, 351 pushing any fluid within the other cylinders 312, 351 to exhaust out of other fluid channels 313, 352.

Figure 5:
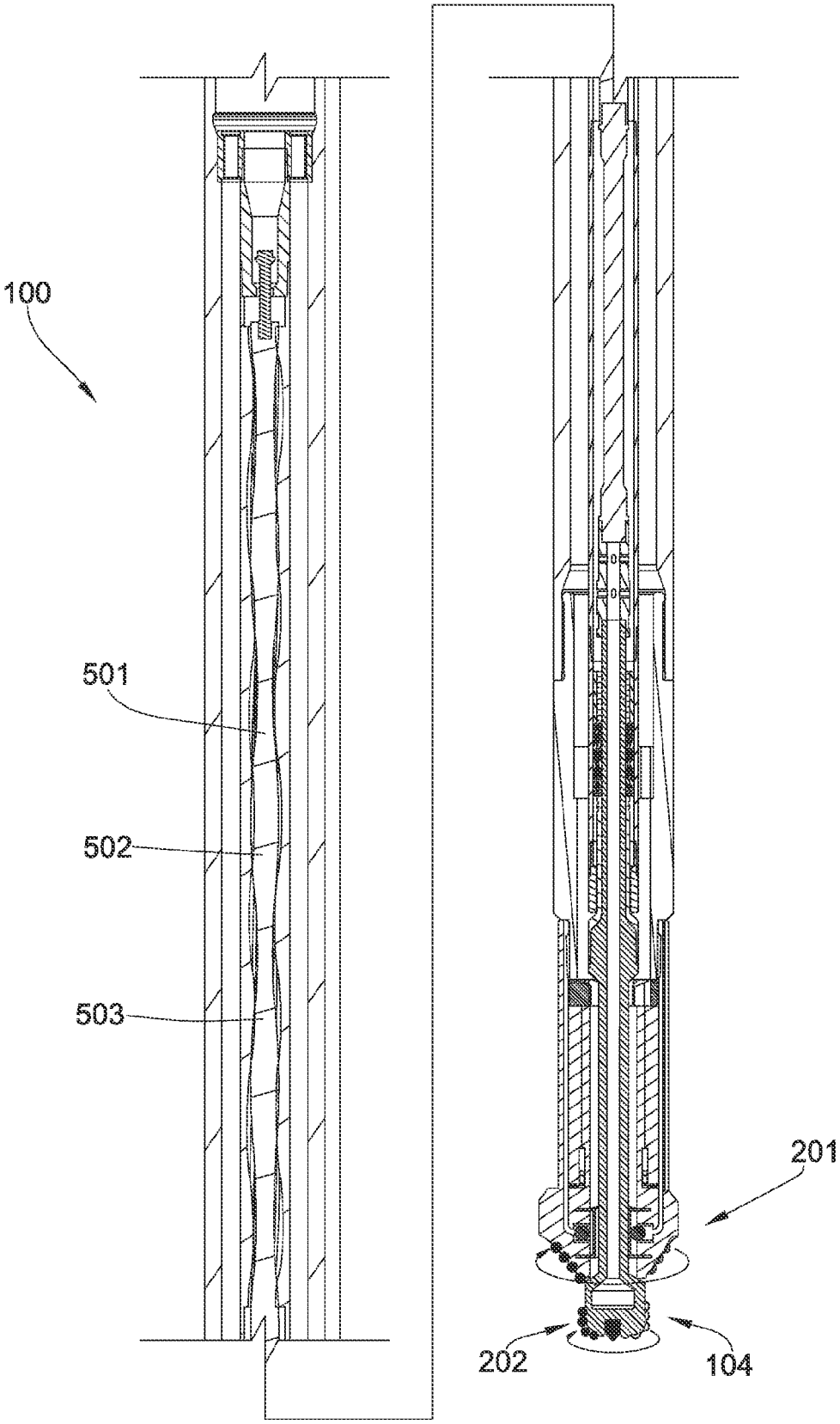
FIG. 5 is a cross-sectional view of an embodiment of a portion of a drill string.

FIG. 5 discloses the outer bit 201 rigidly connected to the tubular components of the drill string 100 and the inner bit 202 rigidly connected to a torque transmitting device 501 disposed within the bore of the drill string. The torque transmitting device may be a mud driven motor, a positive displacement motor, a turbine, an electric motor, a hydraulic motor, or combinations thereof.

In this embodiment, the torque transmitting device 501 is a positive displacement motor 502. The positive displacement motor 502 may comprise a rotor 503. The inner bit 202 may be controlled by the rotor 503 such that the rotor 503 may rotate the inner bit 202. The inner bit 202 may be configured to rotate in a same direction as the outer bit 201. It is believed that configuring the inner bit 202 to rotate in the same direction as the outer bit 201 may allow the inner bit 202 to more easily steer the drill string 100. However, in some embodiments, the outer bit 201 may be configured to rotate in a first direction and the inner bit 202 may be configured to rotate in a second direction.

In some embodiments, the inner bit 202 may be rotationally isolated from the outer bit 201. When the inner bit 202 is rotationally isolated from the outer bit 201, the direction and speed of rotation of the pilot bit 202 may be independent of the rotation of the outer bit 201.

FIGS. 6-10 disclose other embodiments of a drill bit assembly. The drill bit assembly may steer the drill string in a desired trajectory by altering an axis of an inner bit with respect to an axis of an outer bit. Each embodiment comprises an outer bit comprising a bore, and an inner bit connected to a shaft that is disposed within the bore. At least one biasing mechanism may be disposed around the shaft. When fluid flowing through at least one fluid channel is applied to the biasing mechanism, the biasing mechanism may push the shaft and alter an axis of the inner bit.

Figure 6:
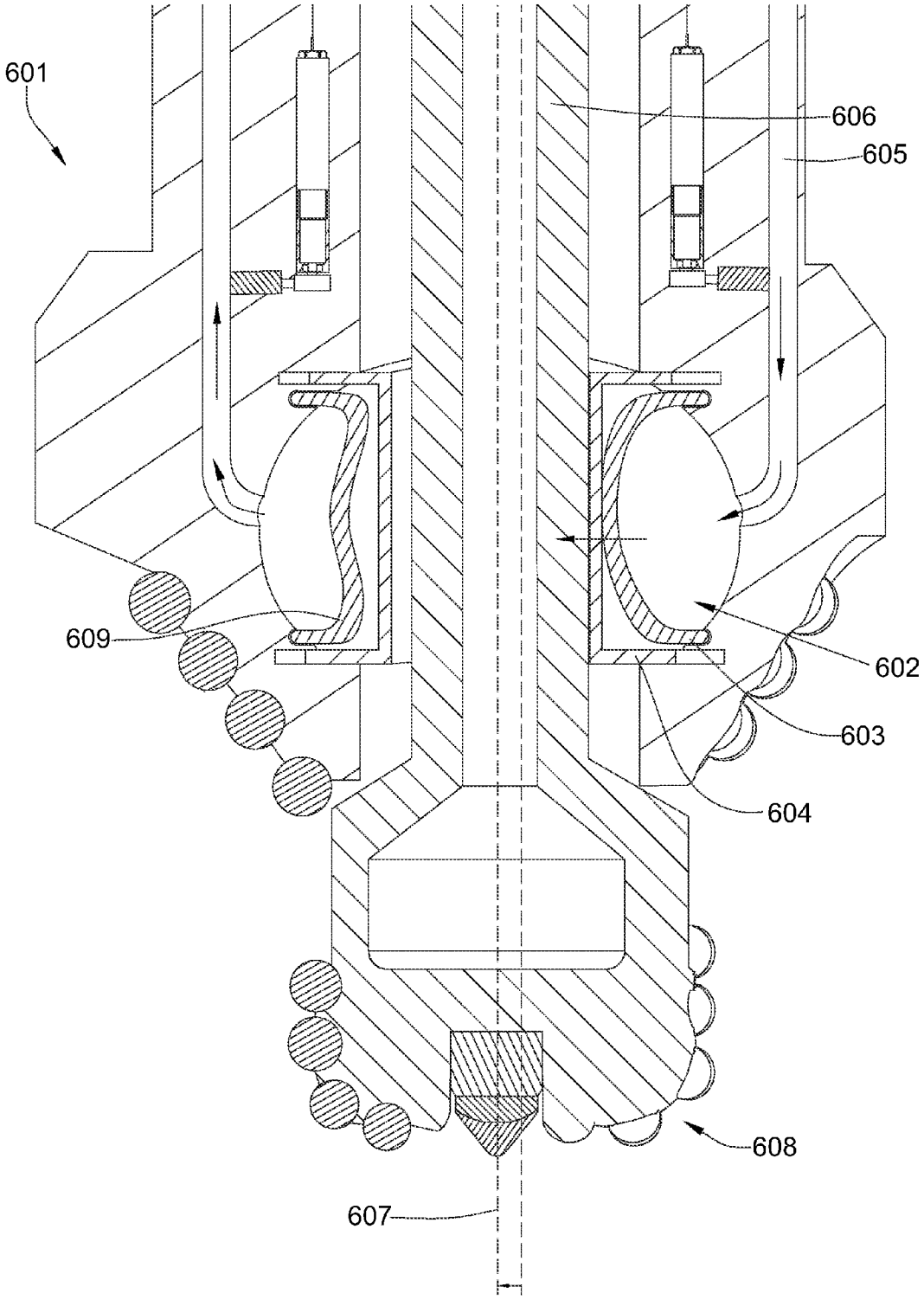
FIG. 6 is a cross-sectional view of another embodiment of a drill bit assembly.

FIG. 6 discloses an embodiment of the drill bit assembly 601 comprising a ring 604 and a biasing mechanism 602 comprising an expandable element 603, such as a fluid filled bladder. The expandable element 603 may be configured to expand with fluid from the fluid channel 605 and bias the ring 604 forcing the ring 604 to push the shaft 606 and alter the axis 607 of the inner bit 608. At the same time, other expandable elements 609 may contract to allow the shaft 606 to be pushed toward the other expandable elements 609. By expanding and contracting, the expandable elements 603 and 609 may cause the axis 607 to shift and thus steer the drill bit assembly 601. It is believed that the expandable element 609 may increase the amount of surface area contacting the ring 604, which may add to the stability of the ring 604 and increase the effectiveness of steering the drill bit assembly 601.

Figure 7:
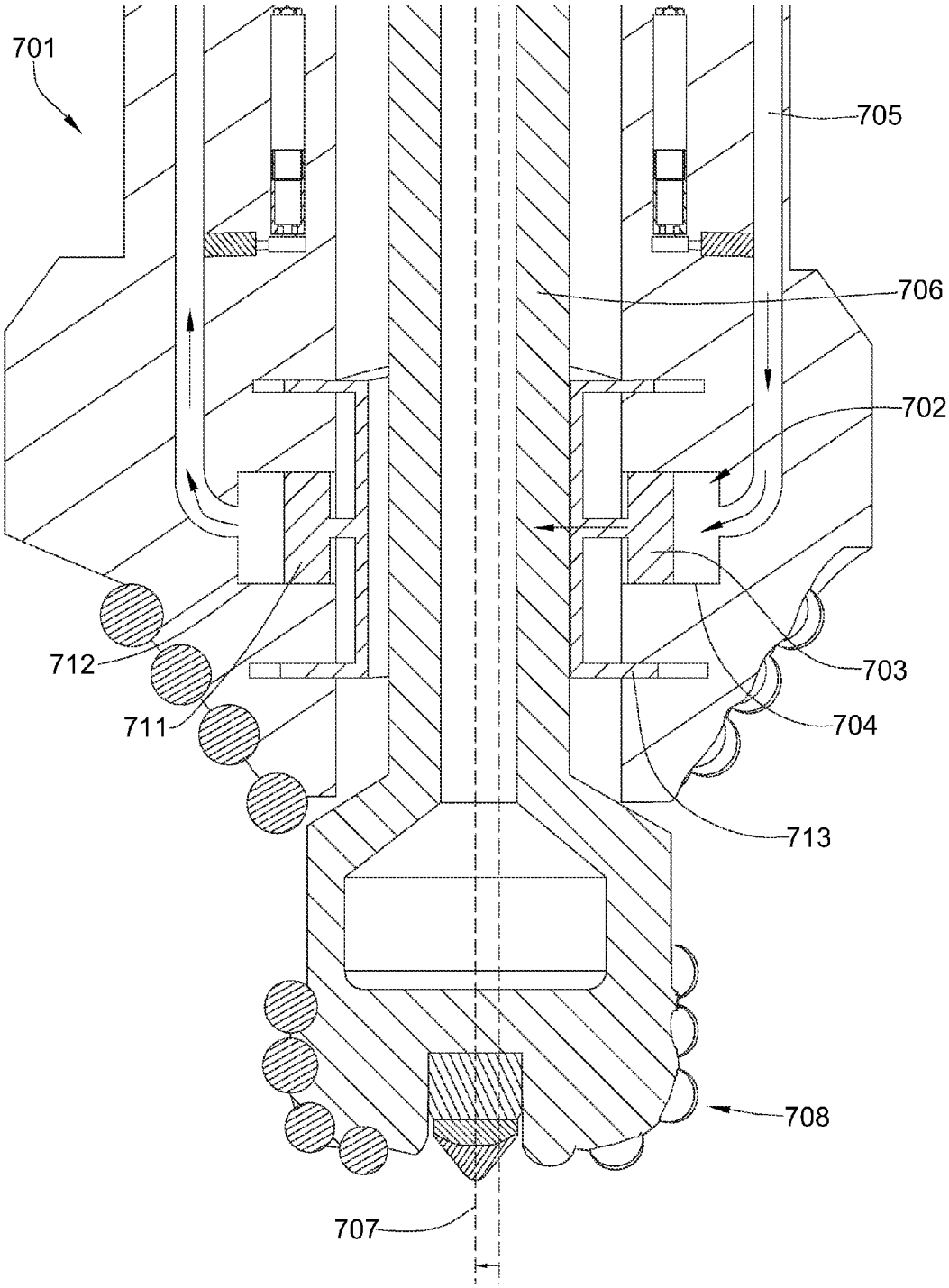
FIG. 7 is a cross-sectional view of another embodiment of a drill bit assembly.

FIG. 7 discloses an embodiment of a drill bit assembly 701 comprising a ring 713 and a biasing mechanism 702. The biasing mechanism 702 may comprise a piston 703 configured to slide within a chamber 704. The piston 703 may slide within the chamber 704 with fluid from the fluid channel 705 and bias the ring 713 forcing the ring 713 to push the shaft 706 and alter the axis 707 of the inner bit 708. At the same time, other pistons 711 may slide within other chambers 712 to allow the shaft 706 to be pushed toward the other pistons 711. By sliding back and forth within the chambers 704 and 712, the pistons 703 and 711 cause the axis 707 to shift and thus steer the drill bit assembly 701. In the present embodiment, the ring 713 is directly connected to the pistons 703 and 711. By directly connecting the ring 713 to the pistons 703 and 711, the fluid may more effectively bias the ring 713.

Figure 8:
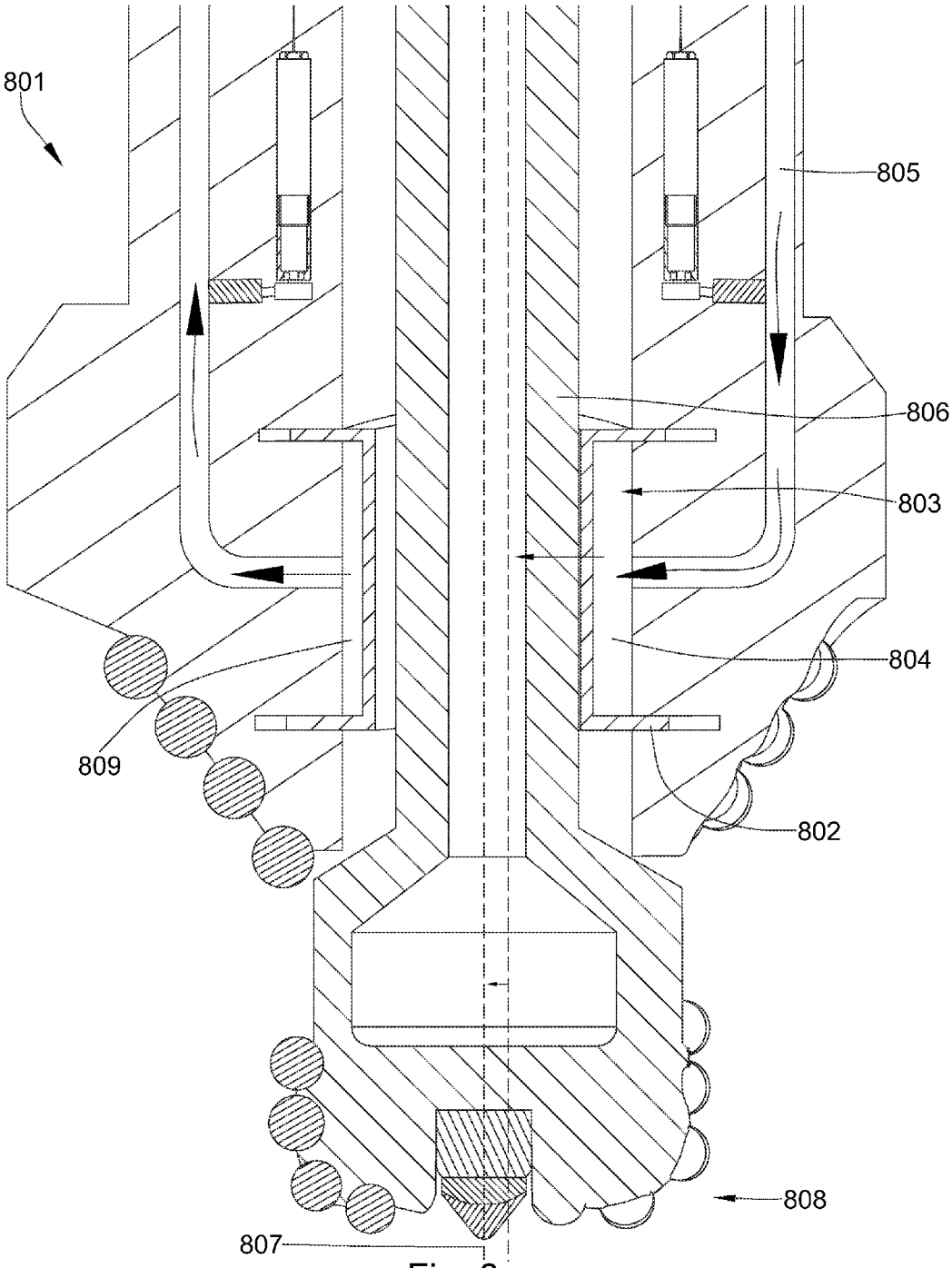
FIG. 8 is a cross-sectional view of another embodiment of a drill bit assembly.

FIG. 8 discloses an embodiment of a drill bit assembly 801 comprising a ring 802 and a biasing mechanism 803. The biasing mechanism 803 may comprise a pressure region 804. The pressure region 804 may be defined by the ring 802 and may fill with fluid from a fluid channel 805. As fluid fills the pressure region 804, the fluid pressure may bias the ring 802 forcing the ring 802 to push the shaft 806 and alter the axis 807 of the inner bit 808. At the same time, fluid in other pressure regions 809 may leave the pressure region 809 to allow the shaft 806 to be pushed toward the other pressure regions 809. By filling and emptying with fluid, the pressure regions 804 and 809 may cause the axis 807 to shift and thus steer the drill bit assembly 801.

Figure 9:
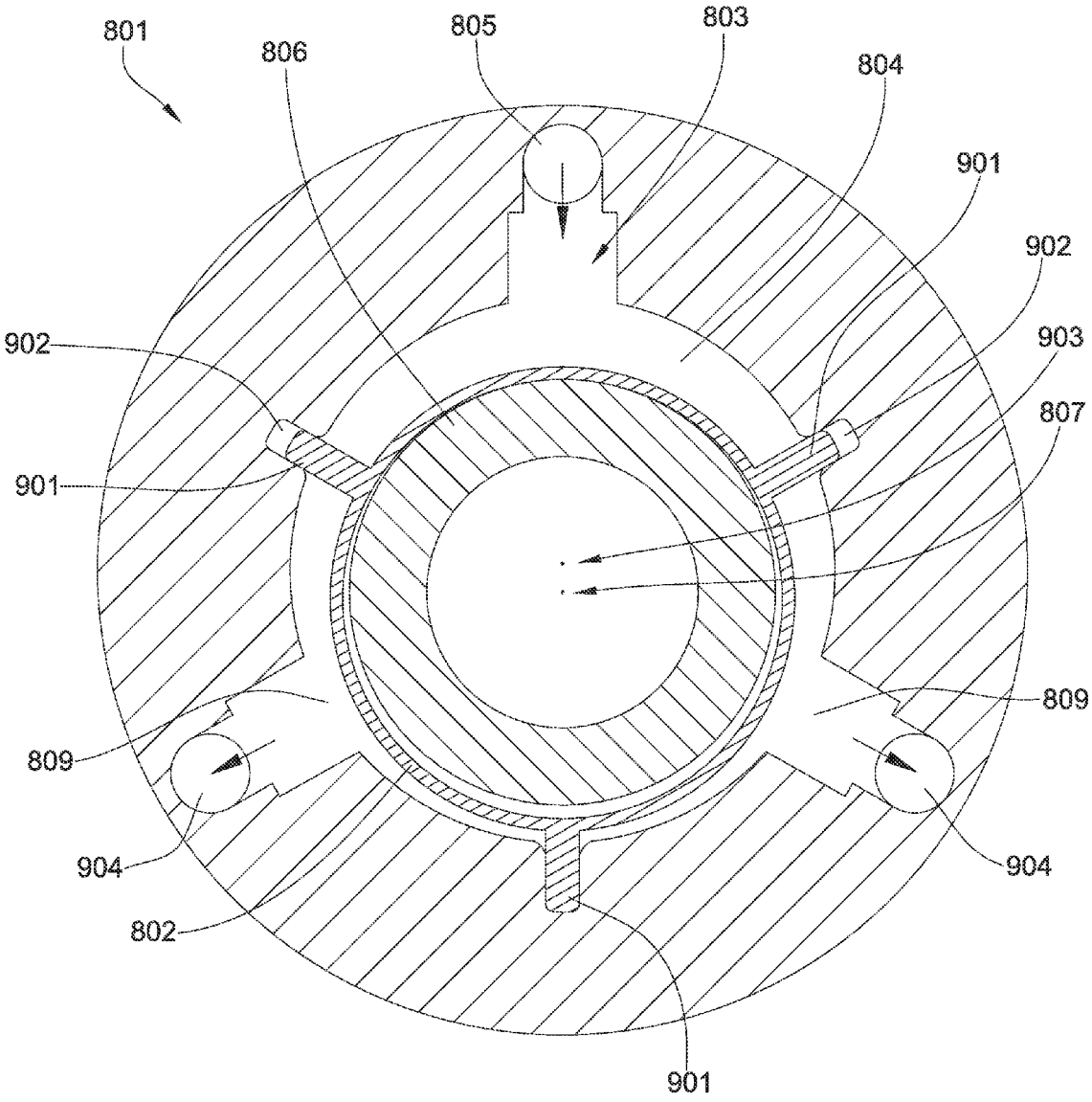
FIG. 9 is a cross-sectional view of another embodiment of a drill bit assembly.

FIG. 9 discloses a cross-sectional view of an embodiment of the drill bit assembly 801 comprising the ring 802 and the biasing mechanism 803. The biasing mechanism 803 may comprise a pressure region 804. The ring 802 may comprise a plurality of vanes 901. The vanes 901 may define the pressure region 804 and the other pressure regions 809. As fluid flows through the fluid channel 805 and into the pressure region 804, the fluid pressure may bias the ring 802 forcing the ring 802 to push the shaft 806 and alter the axis 807 with respect to an axis 903 of the outer bit. As the ring 802 is pushed, fluid in the other pressure regions 809 may exhaust out of the other fluid channels 904. Each vane 901 may be disposed within a recess 902 formed within an inner diameter of the outer bit. As the ring 802 is biased by the pressure regions, the vanes 901 may stay within the guided recesses 902 maintaining a barrier between the pressure regions.

Figure 10:
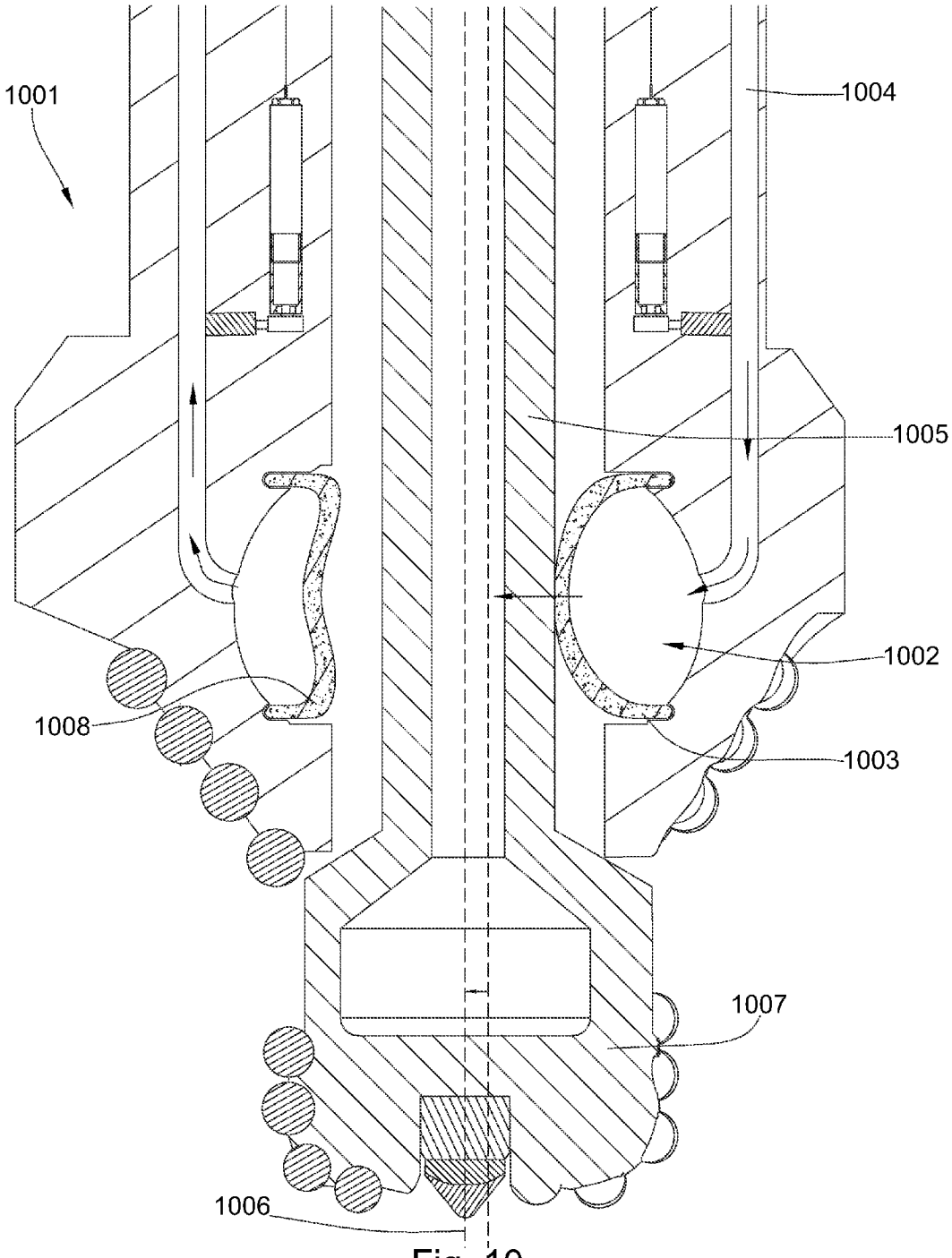
FIG. 10 is a cross-sectional view of another embodiment of a drill bit assembly.

FIG. 10 discloses an embodiment of a drill bit assembly 1001 comprising a biasing mechanism 1002. The biasing mechanism 1002 comprises an expandable element 1003. The expandable element 1003 may be configured to expand with fluid from the fluid channel 1004 and directly push the shaft 1005 and alter the axis 1006 of the inner bit 1007. At the same time, the other expandable elements 1008 may contract to allow the shaft 1005 to be pushed toward the other expandable elements 1008. The expandable elements 1003 and 1008 may each comprise a composite, rubber, metal, ceramic, and/or combinations thereof. In some embodiments, the composite may comprise metal or ceramic pieces embedded into the rubber. In some embodiments, metal or ceramic may form a netting that is disposed within the rubber. The composite, ceramic, or metal materials may reduce the wear on the expandable elements 1003, and 1008. It is believed that because of the material makeup, the expandable elements

1003 and 1008 may push on the shaft 1005 directly even in the presence of drilling fluid and debris disposed within the bore.

Whereas the present invention has been described in particular relation to the drawings attached hereto, it should be understood that other and further modifications apart from those shown or suggested herein, may be made within the scope and spirit of the present invention.

What is claimed is:

1. A steering assembly for downhole directional drilling, comprising:

an outer bit comprising a bore and an outer cutting area;

an inner bit comprising an inner cutting area and connected to a shaft that is disposed within the bore;

at least one biasing mechanism disposed around the shaft;

at least one fluid channel disposed within the outer bit and which directs fluid to the at least one biasing mechanism causing the at least one biasing mechanism to push the shaft and alter an axis of the inner bit with respect to an axis of the outer bit such that the inner bit contacts a formation at a different angle than the outer bit contacts the formation; and a ring, disposed within the bore of the outer bit, configured to act as a buffer between the shaft and the at least one biasing mechanism.

2. The assembly of claim 1, wherein the at least one biasing mechanism comprises an expandable element configured to expand and push the shaft to alter the axis of the inner bit.

3. The assembly of claim 2, wherein the expandable element comprises a composite, rubber, metal, ceramic, and combinations thereof.

4. The assembly of claim 1, wherein the at least one biasing mechanism comprises a piston configured to slide within a chamber and push the shaft to alter the axis of the inner bit.

5. The assembly of claim 1, wherein the at least one biasing mechanism comprises a ball configured to roll within a cylinder and push the shaft to alter the axis of the inner bit.

6. The assembly of claim 1, wherein the ring comprises one continuous body.

7. The assembly of claim 1, wherein the ring encloses the at least one biasing mechanism so to protect the at least one biasing mechanism from drilling fluid disposed within the bore.

8. The assembly of claim 1, wherein the ring is directly connected to the bore and configured to slide radially due to pressure from the at least one biasing mechanism.

9. The assembly of claim 1, wherein the ring is axially fixed within the bore.

10. The assembly of claim 1, wherein the ring comprises a plurality of vanes axially disposed intermediate a plurality of biasing mechanisms wherein the at least one biasing mechanism comprises a pressure region defined by the plurality of vanes.

11. The assembly of claim 1, wherein the ring is directly connected to a piston that is configured to slide within a chamber and force the ring to push the shaft and alter the axis of the inner bit.

12. The assembly of claim 1, wherein at least three biasing mechanisms are equally spaced around the shaft.

13. The assembly of claim 1, wherein the inner bit is configured to rotate in a same direction as the outer bit.

14. The assembly of claim 1, wherein the inner bit protrudes from the outer bit.

15. The assembly of claim 1, wherein the fluid is drilling fluid.

16. The assembly of claim 1, further comprising a valve disposed within the at least one fluid channel and configured to control fluid to the at least one biasing mechanism.

17. The assembly of claim 1, further comprising at least one fluid nozzle disposed on the inner cutting area or a gauge portion of the inner bit.

18. The assembly of claim 1, wherein the outer bit is rigidly connected to a drill string and the inner bit is rigidly connected to a torque transmitting device disposed within the bore.

19. A method of steering a downhole drill string, comprising:

providing an outer bit comprising a bore and an outer cutting area, an inner bit comprising an inner cutting area and connected to a shaft that is disposed within the bore, at least one biasing mechanism disposed around the shaft, least one fluid channel disposed within the outer bit, and a ring disposed within the bore of the outer bit configured to act as a buffer between the shaft and the at least one biasing mechanism;

deploying the drill string within a wellbore;

redirecting a fluid through the at least one fluid channel to the at least one biasing mechanism; and pushing the shaft of the inner bit with the at least one biasing mechanism such that the inner bit contacts a formation at a different angle than the outer bit contacts the formation.

* * * * *